US005570490A

United States Patent [19]

Walsh et al.

[11] Patent Number: 5,570,490

[45] Date of Patent: Nov. 5, 1996

[54] CURTAIN ROD AND ATTACHMENT SYSTEM

[76] Inventors: Daniel Walsh, 1426 Bronte Ct., Lansdale, Pa. 19446; Francis Halligan, 207 S. Dillwyn Rd., Newark, Del. 19711

[21] Appl. No.: 200,646

[22] Filed: Feb. 23, 1994

Related U.S. Application Data

[63] Continuation-in-part of Ser. No. 928,932, Aug. 11, 1992, Pat. No. 5,347,683.

[51] Int. Cl.[6] ..... A47H 15/00

[52] U.S. Cl. ..... 16/87.4 R; 160/330

[58] Field of Search ..... 160/330, 368.1, 160/345; 16/87.2, 87.4 R, 87.6 R, 87.8, 93 D, 95 D, 96 D; 24/105.2; 248/261

[56] References Cited

U.S. PATENT DOCUMENTS 3,703,740 11/1972 Mann et al. .

3,871,082 3/1975 Phlum ..... 16/87.4 R 5,109,912 5/1992 Gary ..... 160/330

5,347,683 9/1994 Halligan et al. .

*Primary Examiner*—Blair M. Johnson

*Attorney, Agent, or Firm*—Sheldon H. Parker

[57] ABSTRACT

A curtain hanging system is disclosed which comprises an I-shaped slide member, the second end of which is portioned to slide within the interior space of a curtain rod, the first end which slides beyond the curtain rod and a middle brace which connects the two. The curtain hanging I-shaped slide is manufactured from a rigid material, such as plastic, lightweight metal or composite. The first end of the I-shaped slide has one portion of a two portion, self-adhering material affixed to it. A curtain hanging kit can be provided with a length of lightweight material with a plurality of the second portion of a self-adhering material on one side. A pressure sensitive adhesive is placed along the other side of the lightweight fabric with a releasable backing material placed over the adhesive. The kit additionally provides a plurality of I-shaped slides, trapezoid-shaped slide members are provided which are used to open and close the curtains.

6 Claims, 7 Drawing Sheets

CURTAIN ROD AND ATTACHMENT SYSTEM

CROSS REFERENCE TO RELATED APPLICATION

This application is a Continuation-in-Part of application Ser. No. 07/928,932, U.S. Pat. No, 5,347,683, filed Aug. 11, 1992.

BACKGROUND OF THE INVENTION

1. Brief Description of the Invention

The instant invention discloses novel curtain rod attachment system using a hook and fabric or hook and loop attachment system, one example of which is sold under the trademark Velcro, in combination with slides, to attach the curtain to a curtain rod.

2. Brief Description of the Prior Art

Curtains have been traditionally connected to rods through a variety of securing means and methods, including hooks as well as direct application to the rod. Once a curtain is directly placed on the rod it can only be replaced, repaired or altered lengthwise or widthwise by removal from the rod and hemming. Changing the length when hooks are used requires removing the curtains and adjusting their position and re-hanging the curtains. Curtains hung by traditional means also do not release when pulled upon. Instead of the curtains' releasing, either the entire rod assembly comes down or the curtains tear. Falling curtains and rods can also be a possible endangerment to small children and to pets, who are most likely to pull or climb on them.

The instant invention overcomes these problems by disclosing a method of hanging curtains that are easily adjustable, replaceable or repairable and release when pressure is applied.

BRIEF DESCRIPTION OF THE DRAWINGS

The advantages of the instant disclosure will become more apparent when read with the specification and the drawings, wherein.

SUMMARY OF THE INVENTION

Figure 1:
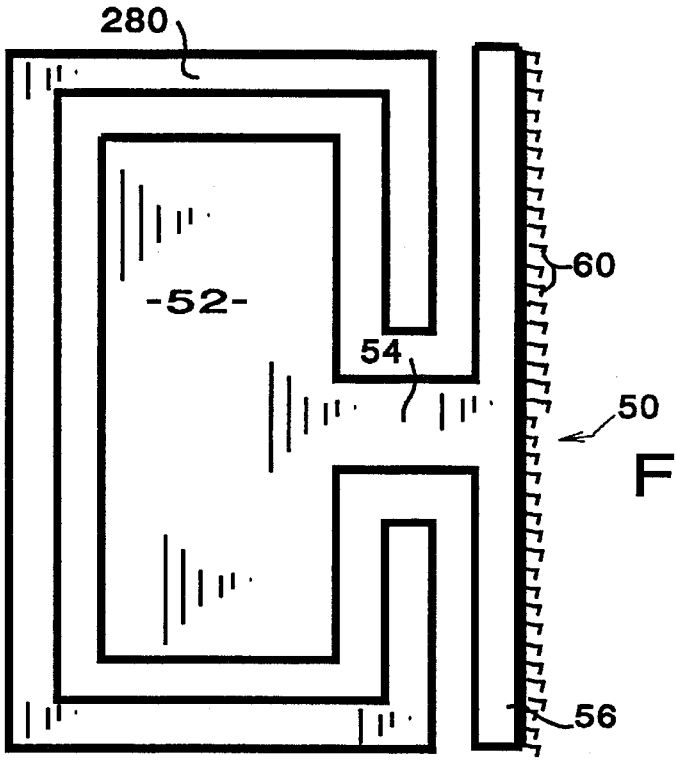
FIG. 1 is a side view of the I-shaped slide of the instant invention.

A curtain hanging system is disclosed which comprises an I-shaped slide member a second end of which is portioned to slide within the interior space of a curtain rod, a first end which slides beyond the curtain rod and a middle brace which connects the two. The curtain hanging I-shaped slide is manufactured from a rigid material, such as plastic, lightweight metal or composite. The first end of the I-shaped slide has one portion of a two portion, self-adhering material affixed to it.

In one embodiment, the first end and said second end have substantially the same dimensions. The first end of said I-shaped slide can further comprises a securing portion which is parallel with and extends over middle brace. The securing portion also has one portion of a two portion, self-adhering material affixed thereto.

The first end of the I-shaped slide can be dimensioned to fit within the stitched pleat of a curtain.

An additional embodiment has an I-slide with a back brace, top brace and front brace. The top brace is at right angles to the back brace and front brace, thereby forming a U-shaped unit. The I-shaped slide is affixed to the back brace within the U-shaped unit. One portion of a two portion, self-adhering material, is affixed to at least a portion of the front brace and top brace. The back brace generally has a length less than that of the front brace, however the second end can be dimensioned less than the first end. Alternatively, the front brace is dimensioned to fit within the stitched pleat of a curtain.

Alternatively the I-shaped slide can have a slide brace which is dimensioned to slide within the interior of the curtain rod. The slide brace has a receiving area within the body of the slide brace, a receiving area dimensioned to allow the second end 26 of the I-slide to rotate within the receiving area and a receiving slot, which provides access to the receiving area and is dimensioned to receive the second end. The slide brace generally has a polygon shape. The first end of the I-shaped slide has one portion of a two portion, self-adhering material affixed thereto. The first end can be dimensioned to fit within the stitched pleat of a curtain.

An alternative system has an ring-shaped slide member which is proportioned to fit around the exterior of a curtain rod. The ring-shaped slide member has one portion of a two portion, self-adhering material affixed to a portion of said ring-shaped slide member. The ring-shaped slide member can have a hinge which is dimension to fit over the curtain rod, thereby locking the ring-shaped member over said rod.

A four sided trapezoid-shaped slide member, which has one part of a two part, self-adhesive system on at least a portion of two of the sides, is used to slide the curtains open and closed. The interior of the trapezoid-shaped slide member is dimensioned to receive a curtain rod. An eye hook extends at right angles to the trapezoid slide member and is used to receive the U-shaped hook section of an opening rod.

Alternatively, the trapezoid-shaped slide member can be provided with a hinge to lock the trapezoid shaped slide onto the curtain rod. The opening rod is used to slide the trapezoid-shaped slide along the rod to open and close the curtains.

As an alternative, a hook slide with an elongated body, one portion of a two-portion, self-adhering material and a hook. The hook extending from the elongated body and is proportioned to fit into commercial hook receiving devices.

A curtain hanging kit can be provided as a single unit which provides a length of lightweight material with a plurality of sections of the second portion of a two portion, self-adhering material on one side. The sections of the two portion self-adhering material are affixed an equidistance from one another. A pressure sensitive adhesive is placed along the other side of the lightweight fabric with a backing material placed over the adhesive. The backing material serves as a releasable protective cover for said self-adhering adhesive. The kit additionally provides a plurality of I-shaped slides, one end of which is proportioned to slide within the interior space of a curtain rod. The other end of the I-shaped slide has the first portion of a two portion, self-adhering material affixed to it. A pair of trapezoid-shaped slide members are provided which are used to open and close the curtains.

DETAILED DESCRIPTION OF THE INVENTION

The rails and slides have been disclosed in full in the pending U.S. Pat. No. 07/928,932, the information of which is incorporated herein as if cited in full.

The I-shaped slide 50 of FIG. 1 is designed to be used with any standard curtain rod, represented by rod 280, or the rod disclosed in co-pending application U.S. Ser. No. 07/928,932. The I-shaped slide 50 has a base portion 52 which is dimensioned to slide within the rod 280 and allows for the movability of the curtains. The I-shaped slide 50 has a leg section 54, at right angles to the base portion 52, which connects the base portion 52 to the curtain receiving portion 56. The leg section 54 is dimensioned to allow for the curtain receiving portion 56 to clear the rod 280, thereby allowing for free movement of the curtains. The I-shaped slide 50 can be shaped, formed or extruded from plastic, metal, composite or other material and cut to the required width, thereby allowing for the varying of the widths dependent upon the weight of the curtain. The leg section 54 has affixed thereto one part of a two part, self-affixing material. The hook and loop system employs a first part which consists of a hook section and a second part which consists of a loop or fabric section. The hook and loop system, as described herein is used as an example for simplicity and should not be considered to limit the scope of the invention. Any type of two part system can be used which will meet the standards as set forth herein. For ease of disclosure, however, reference will be made to the two component, hook and loop attachment system. As is well-known in the art, the flexible plastic hook elements of the first component part engage the loop fibers of the second part, providing a releasable attachment mechanism. The two parts have a high resistance to separation under a force which attempts to tear apart the two components of the attachment system. However, the two components will separate readily under a peel force. It should also be noted that the attachment of the hook to the slides herein and the loop to the curtains can be reversed and is used consistently herein for clarity. The hook section 60 of the attachment system is affixed to the curtain receiving portion 56 through adhesive means well-known in the prior art. The base portion 52 of the I-shaped slide 50 can, optionally, be coated, tipped or edged with teflon, silicon or other lubricous materials to enhance sliding.

Figure 2:
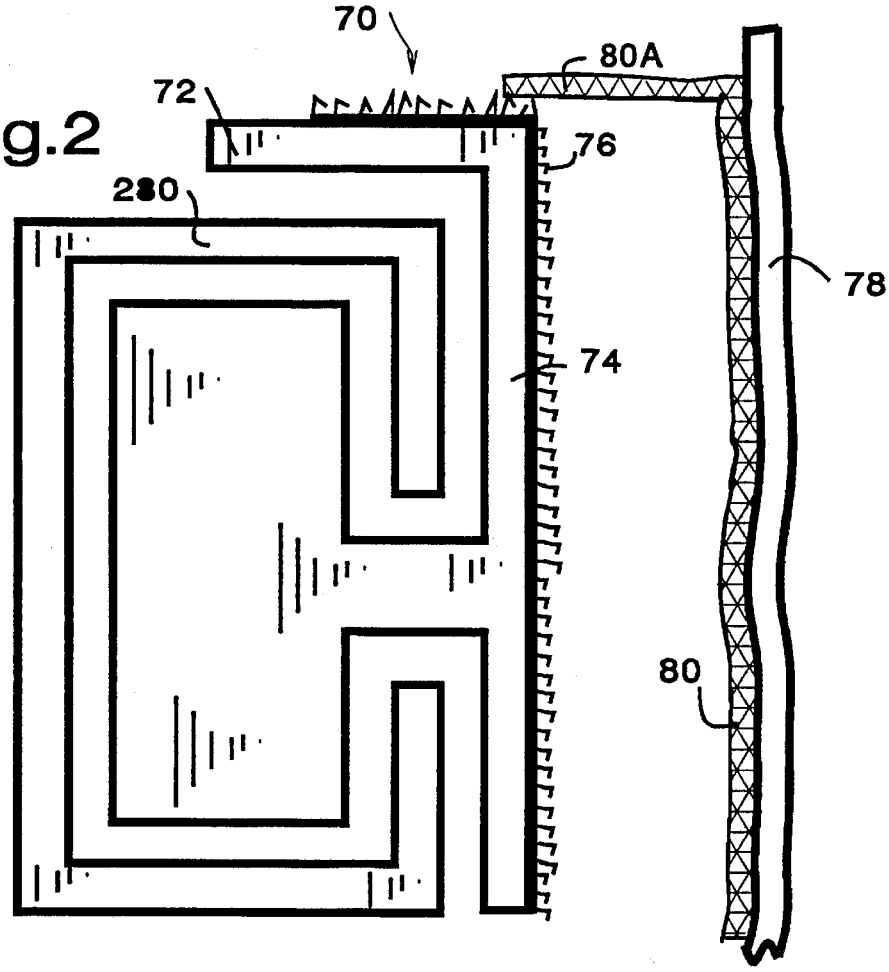
FIG. 2 is a side view of an alternate embodiment of the I-shaped slide of the instant invention, adding a support brace.

The I-shaped slide 70, illustrated in FIG. 2, is manufactured with an additional curtain brace 72. The curtain brace 72 is placed at right angles to the curtain receiving portion 74 to provide for additional support. The hook section 76 is affixed to the curtain receiving portion 74 and the curtain brace 72. The loop portion 80 of the attachment system is applied to the curtain 78, with the extended loop portion 80A extending beyond the top edge of the curtain 78. When mounting the curtain, the extended loop portion 80A is placed over the hook section 76 of the additional curtain brace 72. This additional brace provides additional support for heavy weight curtains and places the weight of the curtains into a 'pull' position versus a peel position. This prevents the weight of the heavy curtains from peeling the loop portion 80 from the hook section 76 while still allowing release if abnormal pressure is applied.

To mount the curtains, the loop portion 80 of the attachment system is placed along the top of the curtains in the place of the standard hooks. The loop portion 80 can either be stitched to the curtains or an adhesive suitable for use with fabrics can be applied. The greater the height of the loop portion, the greater the curtain length can be equally adjusted by simply affixing the loop portion to the hook portion. In the event that prestitched, pleated curtains are used, the loop portion is generally applied only to the prestitched portion. The loop portion can, however, be applied to the entire width of the curtain, providing additional flexibility in the arrangement of the curtains on the rods as well as depth of pleats. If the curtains are to be loosely gathered on the rod using an unpleated curtain, it is recommended that the loop portion be run along the length of the curtain to allow for visual adjustments to the curtain once it is mounted. The loop portion is attached to the hook portion which has been affixed to the I-shaped slides 50. In the event that traverse rods are used, the slides noted herein holding the curtains are placed along the rail in the desired positioning by the user. The instant system can be used with manually opened and closed curtains which provides no change other than convenience and safety. Additionally, the instant system can be used with curtains which are not moved but rather left in a closed or open position.

Figure 3:
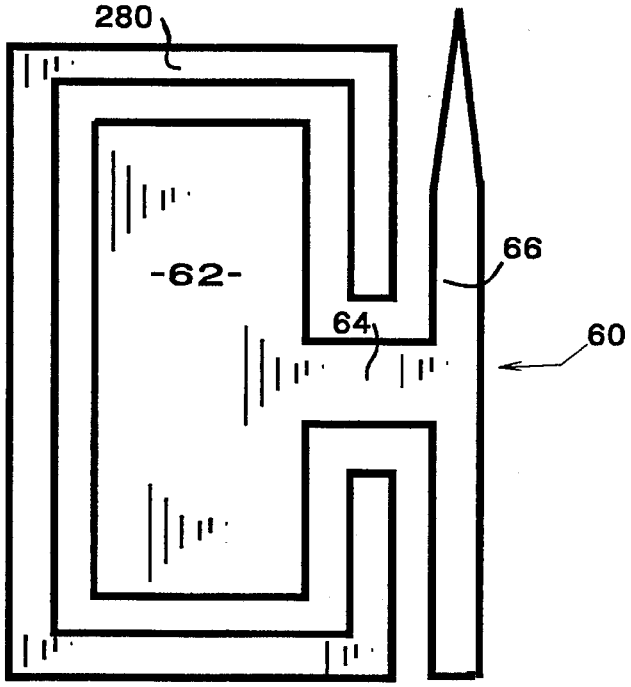
FIG. 3 is a side view of an alternate embodiment of the I-shaped slide of the instant invention to be incorporated with stitched drapes.

The alternate embodiment in FIG. 3 illustrates a slide 60 which has an elongated insert 66 replacing the curtain receiving area 74. The elongated insert 66 allows slide 60 to be used with prestitched draperies without the addition of the attachment system. The slide base 62 and leg section 64 are dimensioned as previously disclosed in the prior figures.

Figure 4:
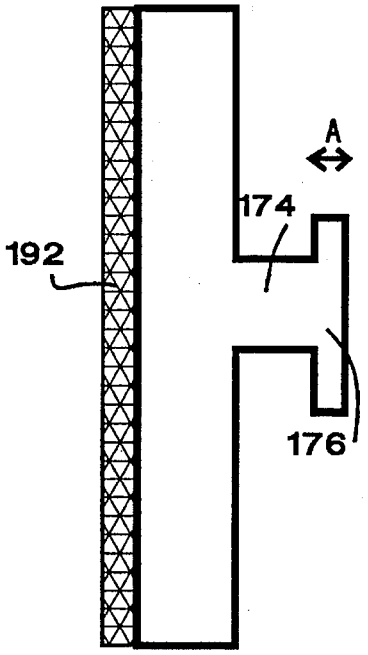
FIG. 4 is a side view of an alternate embodiment of the I-shaped slide of the instant invention to be used with a twist-on base.
Figure 5:
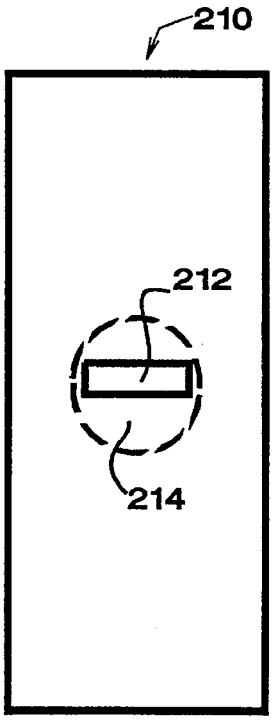
FIG. 5 is a side view of the twist-on base used with the I-slide of FIG. 4.

FIGS. 4 and 5 illustrate an alternate embodiment to the heretofore disclosed I-shaped slides. The I-slide 170 has a leg 174 which spaces the curtain receiving portion 172 from the slide locking bar 176. The locking bar 176 is at right angles to the leg 174 and is proportioned to fit within the receiving notch 212 of the slide base 210, shown in FIG. 5. The slide base 210 is dimensioned to fit within the rod as heretofore disclosed. To connect the I-slide 170 and the slide base 210, the I-slide 170 is turned at right angles to the slide base 210 and the slide locking bar 176 is inserted into the receiving notch 212. The I-slide 170 is turned to be parallel with the slide base 210, thereby locking the I-slide 170 to the slide base 210. The slide base 210 is provided with an interior turning area 214 to allow for the rotation of locking bar 176. Once turned, the slide locking bar 176 is locked within the slide base 210. The depth of the receiving notch 212 and interior turning area 214 is dimensioned to be slightly greater than the depth A of the slide locking bar 176. This dimensioning locks the curtain receiving portion in a position with the slide base 210 which allows for little or no movement. The curtain receiving portion 172 is covered with the loop portion 192 of the attachment system. The I-slide 170 can, optionally, provide the same configuration as I-slide 70, thereby providing the additional support provided by the additional curtain brace 72 of FIG. 2.

Figure 6:
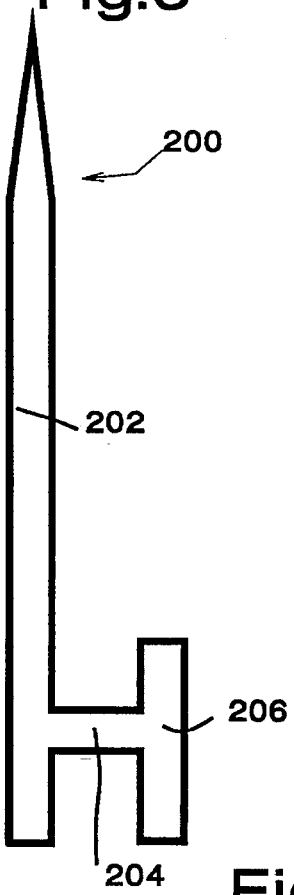
FIG. 6 is a side view of an alternate embodiment of the I-shaped side of FIG. 4.

FIG. 6 illustrates an alternate embodiment to the locking I-slide 170. The curtain retaining portion 202 of the slide 200 is narrower and has a pointed end to fit within the standard curtain receiving areas. The leg 204 and locking bar 206 are positioned toward the bottom of the curtain retaining portion to allow for clearance of the stitched area of the curtain. The slide 200 is locked within the slide base 210 as described heretofore.

Figure 7:
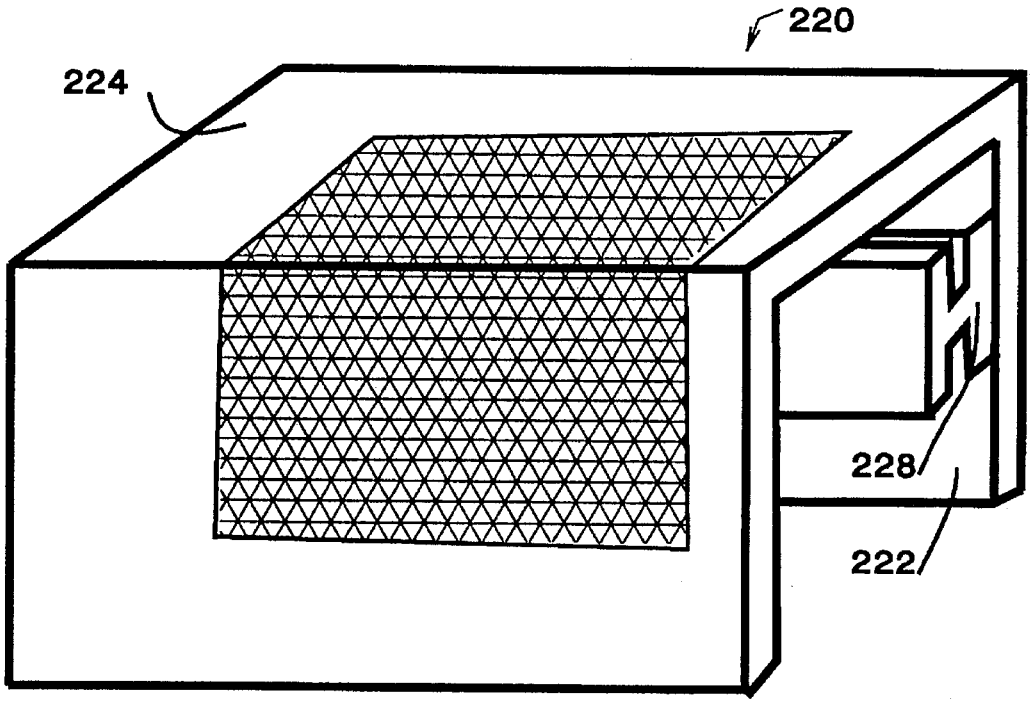
FIG. 7 is a perspective view of an alternate embodiment of the slide of the instant invention.
Figure 8:
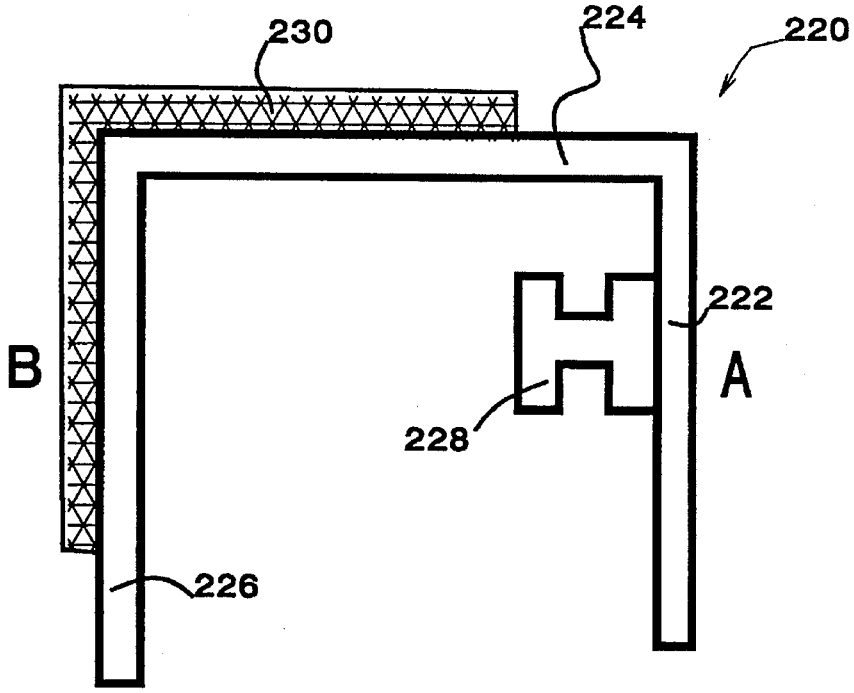
FIG. 8 is a side view of the slide of FIG. 7.
Figure 16:
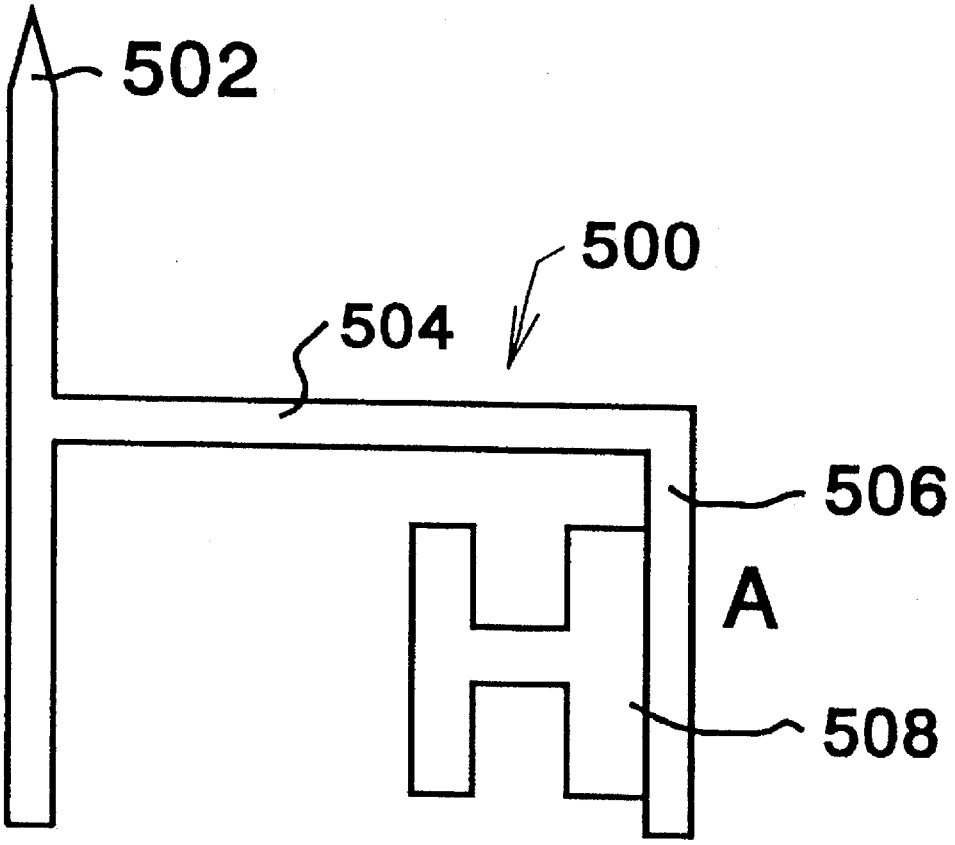
FIG. 16 is a side view of an alternate embodiment to FIGS. 7 and 8.

FIGS. 7 and 8 illustrate an alternate, approximately n-shaped slide unit 220. The approximately n-shaped slide unit 220 can be used with either the conventional curtain rods or the rod of the copending case cited above. The curtain rod receiving bracket 228 is I-shaped and is dimensioned to fit within the curtain rod as previously disclosed. The rod receiving bracket 228 is slid within the open channel of a standard curtain rod, thereby placing the curtain receiving area 226 opposite the open channel of the rod. The curtain rod receiving bracket 228 of the approximately n-shaped slide unit 220 extends from the slide backing 222. The curtain rod receiving bracket 228 can be manufactured as a separate piece and affixed to the slide backing 222, or the approximately n-shaped slide unit 220 can be manufactured in one piece. The slide top 224 and curtain receiving area 226 complete the approximately n-shaped slide unit 220. The slide top 224 is dimensioned to allow the curtain receiving area 226 to clear the curtain rod and to provide any additional overhang required. The slide backing 222 can have a height less than the curtain receiving area 226 in order to make the unit lighter and more economical to manufacture. The height in the curtain receiving area 226 is provided to allow for greater rod to floor adjustability of the drape or curtain. Although the curtain receiving area 226 and slide backing 222 can be the same height it would provide no benefit to the slide unit 220. The loop portion 230 is adhered to at least a portion of the curtain receiving area 226 and slide top 224. The curtains are affixed through use of the two part attachment system as disclosed previously. An alternate to FIGS. 7 and 8 is illustrated in FIG. 16. The curtain receiving area 226 of the approximately n-shaped slide unit 220 is replaced with a curtain retaining rod 502 in the slide unit 500. The curtain retaining rod 502 is dimensioned to fit within the prestitched pleats of ready made curtains. The slide unit 500 is designed with a receiving bracket 508 which is slid within the open channel of the curtain rod, a slide backing 506 and a slide top 504.

Figure 9:
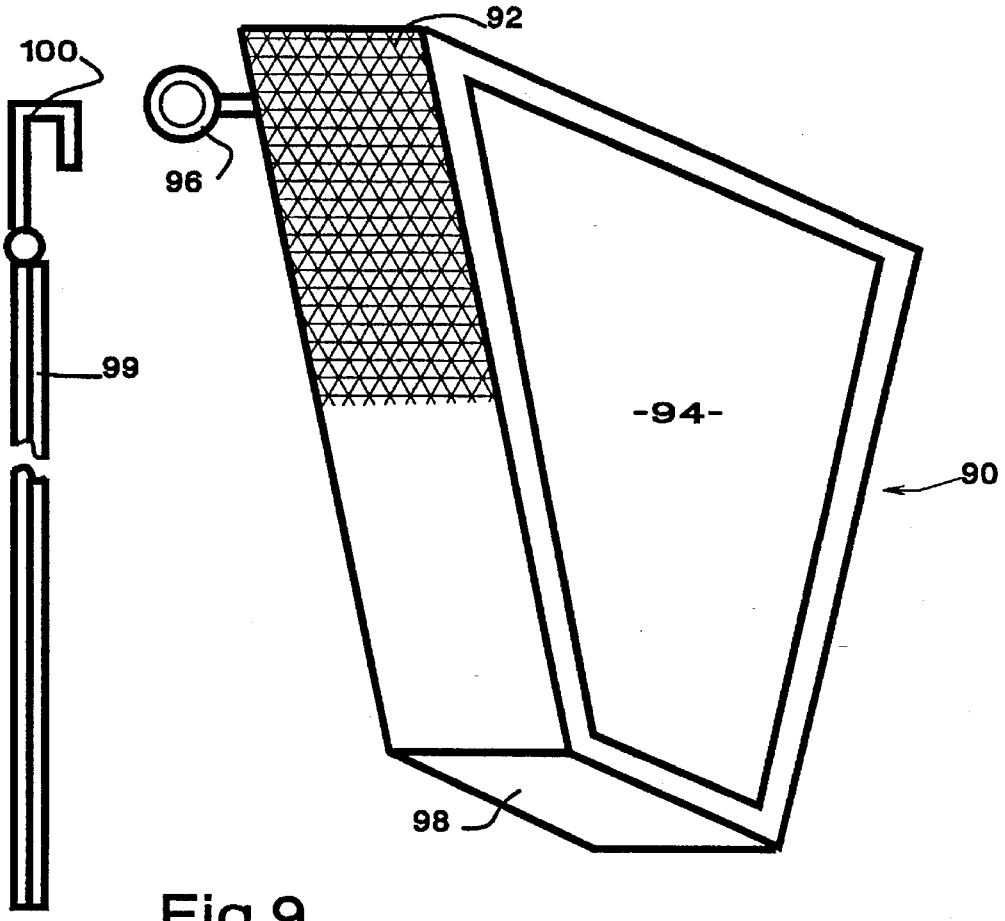
FIG. 9 is a perspective view of an end-slide of the instant invention.
Figure 10:
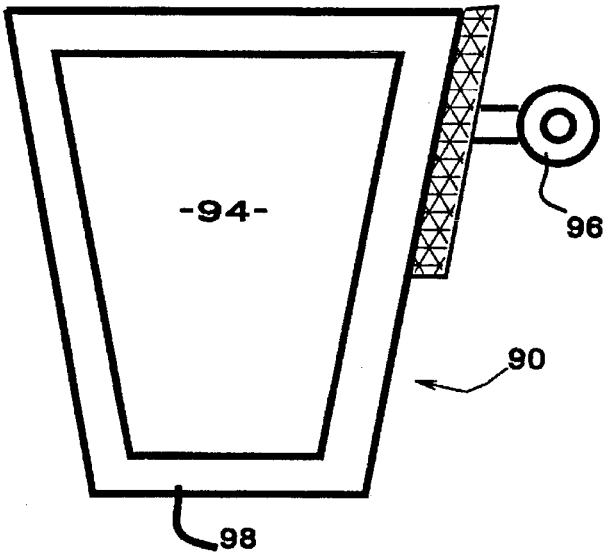
FIG. 10 is a side view of the end-slide of FIG. 9.

FIGS. 9 and 10 disclose an end slide 90 which is placed on the opening edges of the curtains. The end slide 90 is trapezoidal in shape, with an open center 94. The loop portion 92 is affixed to one side of the end slide 90 for attachment of the curtains. A loop 96 is attached to the end slide 90, adjacent to the loop portion 92 and along the edge of the slide 90. The loop 96 is preferably positioned to allow the open portion of the loop to be parallel with the base 98 of the end slide 90. The end slide 90 is placed at the edge of the curtain in a position to allow the loop 96 to extend beyond the curtain. The loop 96 must be adjacent to the edge of the end slide 90 to prevent the end slide 90 from obviously extending beyond the curtain edge when in position. A pair of the slides 90 are placed over the curtain rod prior to the addition of the remaining slides. A rod 98, having a hook 100 at one end is provided for opening and closing the curtains. The hook 100 is placed in the loop 96 and used to pull the curtains open or closed.

Figure 11:
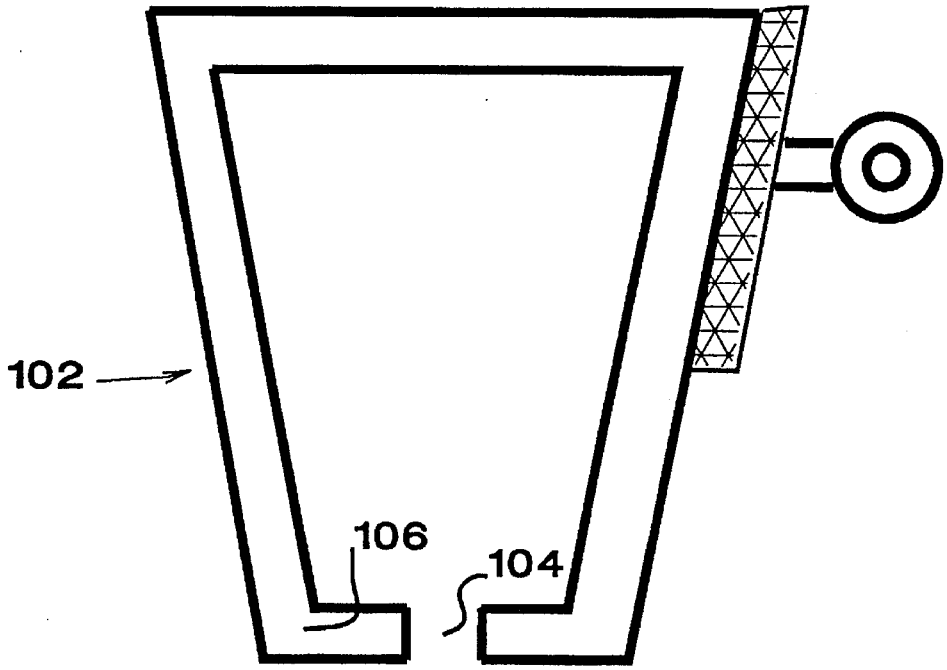
FIG. 11 is an alternate embodiment of the end side of FIG. 9.

FIG. 11 illustrates end slide 102 which is a modification of the end slide 90. The base 106 of the end slide 102 is provided with an open slot 104 which is dimensioned to fit over a curtain rod. The open slot 104 allows the slide 102 to be added to curtains that have already been hung without removal of the curtains.

Figure 12:
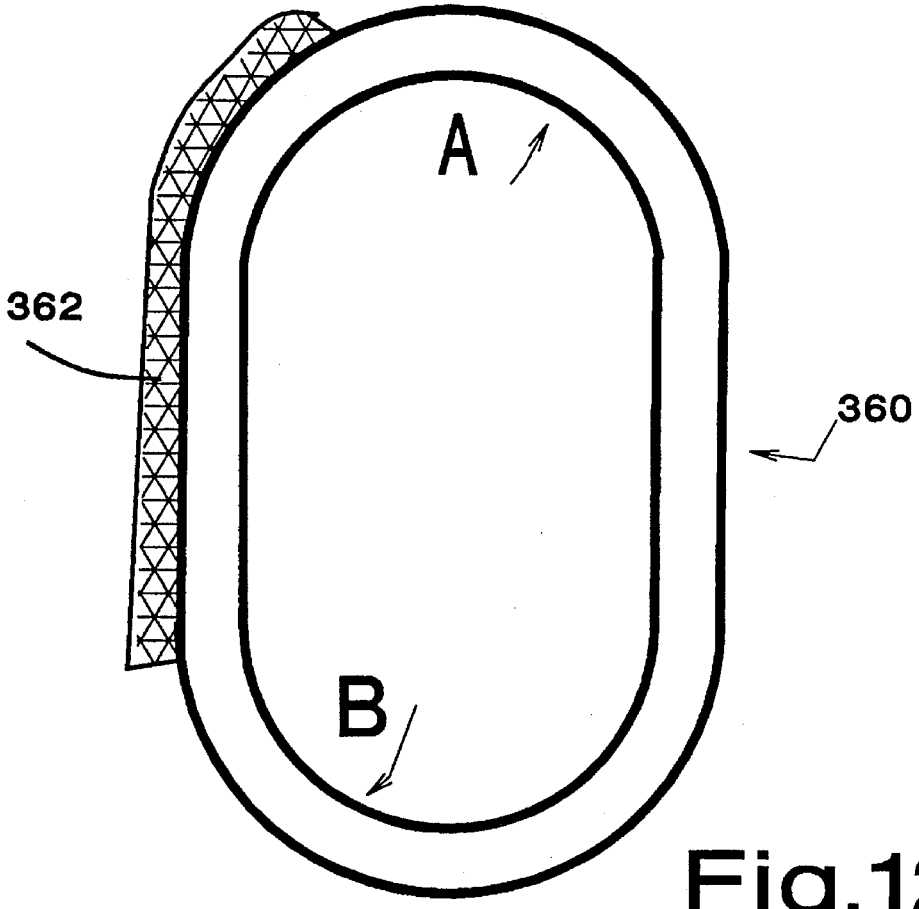
FIG. 12 is a side view of an alternate slide as disclosed in the instant invention.
Figure 13:
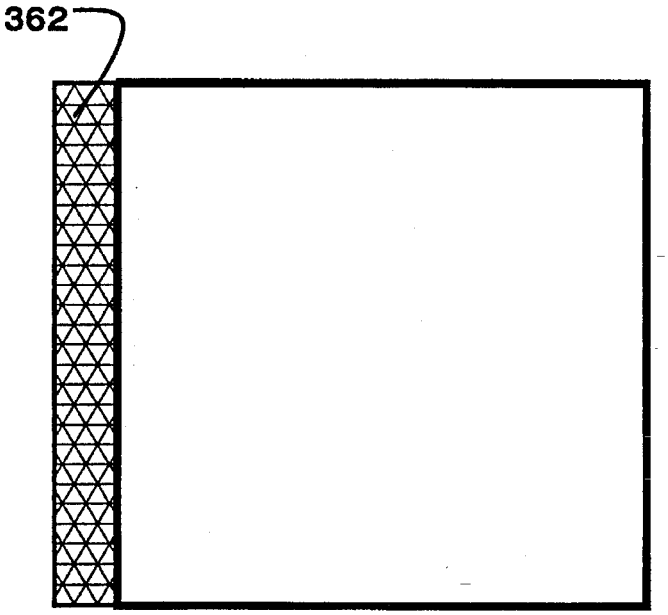
FIG. 13 is a top view of the slide of FIG. 12.

FIGS. 12 and 13 show an alternate slide device. The ellipse-shaped or ring-shaped slide 360 is dimensioned to fit over any curtain rod and can be manufactured from fabric, metal, composite or plastic. The slide 360 is illustrated herein as elliptical, however, the slide 360 can also be circular or oval. The loop portion 362 of the attachment system is affixed to one long side, extending slightly over the curve. The loop portion 362 cannot extend to the top of the curve as the weight would cause the ellipse-shaped slide 360 to rotate on the rod. The illustrated weight distribution, in combination with the elliptical shape, causes the ellipse-shaped 360 to come in contact with the rod at arrows A and B. This contact causes a binding between the ellipse-shaped 360 and the rod, preventing the ellipse-shaped 360 from rotating around the rod. The loop portion 362 can extend past the bottom of the slide, hanging essentially unattached. This provides improved resistance to rotation and may be required on some drapes or curtains that are weight sensitive.

Figure 14:
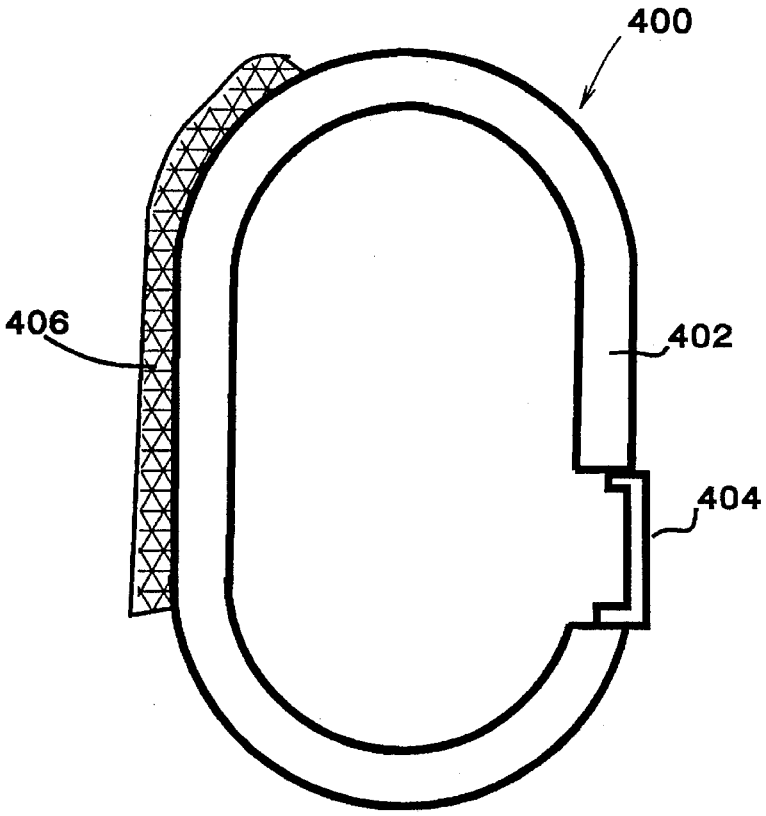
FIG. 14 is a side view of an alternate embodiment of the slide of FIG. 12.

The slide 400 of FIG. 14 is an alternative to the ellipse-shaped 360; incorporating a hinge 404 which allows the slide 400 to be placed over the curtain rod rather than slid on at the ends. The hinge 404 is attached to the slide 400 body 402 and can be manufactured in any of the methods known in the prior art, dependent upon the material of manufacture.

Figure 15:
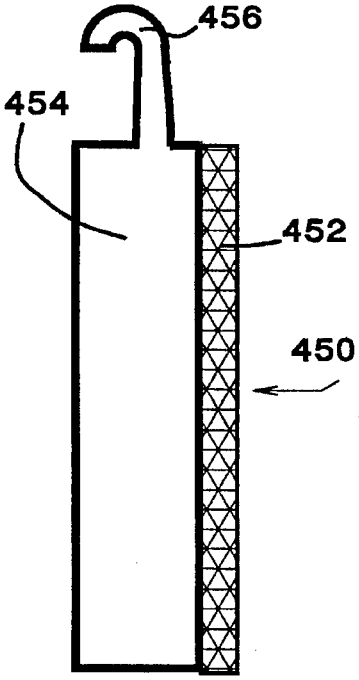
FIG. 15 is an additional embodiment of the slide of the instant invention.

FIG. 15 is a side view of a slide 450 for use with the loop attachments commonly found on many curtain rods. The slide 450 has the loop portion 452 affixed to the body 454 to receive the hook portion affixed to the curtains. A hook 456 extends from the top of the body 454 and is dimensioned to fit into the loop attachments of the rods. This allows the attachment system to be used with decorative pole rods, as well as any other curtain rods which do not have the open channel.

The instant device is optimumly sold as a system manufactured completely by curtain manufacturers or a prepackaged kit containing the attachment system and slides. For unpleated and/or light weight curtains, the loop for the curtains is provided in a continuous strip which is backed with a fabric adhesive with a peel-off cover. Heavier weight curtains can be provided with a double strip of loop to carry the extra weight. The slides in the kit are provided with the hook portion of the system already attached. To utilize the kit with existing curtains, the curtains are laid on a flat surface and the loop portion cut to the width of the curtains. The peel-off cover is removed and the loop portion placed on the back of the curtain. An unheated iron or other instrument to apply pressure is used to seal the adhesive to the fabric. Alternatively, the loop can be ironed on with a hot iron, providing a more permanent bond. The loop-backed curtain is then mounted on the hook portion of the slides as previously described.

Curtains with pre-sewn pleats can be provided with a fabric/loop portion combination instead of the continuous loop portion. A thin cloth, such as muslin, is provided with strips of the cloth covered with the loop portion. The loop portion strips should be spaced approximately equidistant from the curtain pleats and each strip should be the width of the pleat. The cloth is provided with a pressure adhesive with a peel-off backing, as described above. The cloth is cut to length and the peel-off backing removed. The loop portion strips are aligned with the pleats and the cloth is adhered through pressure to the curtain. The cloth's position between the pleats allows the curtain flexibility as well as reduces the weight. As an alternative, the muslin can be stitched to the curtains.

The above kit can, for example, include a precut roll of loop portion or cloth/loop portion combination and slides for set window widths.

The slides, except for the elliptical loops manufactured from fabric, and base disclosed are manufactured from any rigid material, such as metal, composites or plastic. The gauge must be sufficient to allow for the slides to sustain the weight of the curtains.

What is claimed is:

1. A curtain hanging system, said curtain hanging system comprising:

an I-shaped slide member, said I-shaped slide member having a first end, a second end and a middle brace;

said second end of said I-shaped slide member being portioned to slide within the interior space of a curtain rod;

said middle brace of said I-shaped slide member being portioned to slide within the channel of said curtain rod;

an approximately n-shaped slide unit, said approximately n-shaped slide unit having a back brace, a top brace and a front brace, said top brace being at right angles to said back brace and said front brace, wherein said I-shaped slide is affixed to said back brace within said approximately n-shaped unit.

2. The curtain hanging device of claim 1 wherein said curtain hanging system is manufactured from a rigid material.

3. The curtain hanging device of claim 2 wherein said material is plastic.

4. The curtain hanging system of claim 1 further comprising one portion of a two portion, self-adhering material, said one portion being affixed to at least a portion of said front brace and said top brace.

5. The curtain hanging system of claim 4 wherein said back brace has a length less than that of said front brace.

6. The curtain hanging system of claim 1 wherein said front brace is further provided with a rod member, said rod member being dimensioned to fit within the stitched pleat of a curtain.

* * * * *